United States Patent [19]

Norman

[11] 4,270,582

[45] Jun. 2, 1981

[54] SPRING NESTING APPARATUS

[75] Inventor: Harry H. Norman, Dana-Point, Calif.

[73] Assignee: Eleven States Mfg. Corp., South Gate, Calif.

[21] Appl. No.: 39,884

[22] Filed: May 17, 1979

[51] Int. Cl.[3] ..... B21F 35/04

[52] U.S. Cl. ..... 140/71 R; 53/118; 72/133

[58] Field of Search ..... 72/133, 134, 169; 140/90, 91, 105, 71 R; 242/81; 53/116, 117, 118, 119, 246

[56] References Cited

U.S. PATENT DOCUMENTS

| | | | |
|---|---|---|---|
| 2,700,409 | 1/1955 | Weiss | 140/105 |
| 3,113,410 | 12/1963 | Pottle | 53/119 |
| 4,121,628 | 10/1978 | Waligore et al. | 140/105 |

*Primary Examiner*—Lowell A. Larson
*Attorney, Agent, or Firm*—Lyon & Lyon

[57] ABSTRACT

An apparatus is disclosed for nesting and concurrently controlling the rotational alignment of nested spring elements. A mechanically programmable timing chain determines the arrangement of nested curvilinear spring elements and the number of nested spring elements within a storage configuration.

12 Claims, 13 Drawing Figures

SPRING NESTING APPARATUS

BACKGROUND OF THE INVENTION

This invention relates to an apparatus for nesting curvilinear articles, and more particularly sinuous spring elements such as found in upholstery.

During the course of upholstering, it is desirable to use spring elements having a sinuous shape. Attention is drawn to U.S. Pat. No. 2,800,928 for a description of the manufacturing process of said spring elements. It is to be noted that these spring elements are of a curvilinear shape, this shape being the basis for their elastic nature. A recurrent problem with the use of said elements is the difficulty incurred in storing said elements because of their unusual shape. In response to this problem, it has been shown that a nested bundle is the optimum storage configuration for these elements.

In manufacturing precut spring elements, however, the elements have been produced by an apparatus which separately ejects each cut spring element. These ejected spring elements are then manually nested. It has been found to be extremely difficult to manually nest these precut spring elements once they have attained their curvilinear form. Additionally, the apparatus which has made these curvilinear sinuous spring elements, forms, and ejects these elements at speeds substantially greater than can be nested by hand. Consequently, to balance spring production with spring nesting, these apparatus' have been caused to run at speeds well below their operational capability.

Along with the need to speed up the nesting process, it was desired that the curvilinear sinuous spring elements found within the nested configuration be aligned in a particular manner. It became apparent that by being able to control the rotational alignment of these spring elements with respect to one another more spring elements could be placed in a given nest size. Manual nesting of precut sinuous spring elements provided no accurate method for accomplishing these desirable results at a reasonable production rate.

SUMMARY OF THE INVENTION

According to the present invention there is provided an apparatus for nesting precut curvilinear spring elements in a manner which accomplishes the object of efficient and optimum storage. The apparatus comprises an arching roll which imparts a curvilinear shape to precut spring elements. The curvilinear spring elements are then engaged by a feed wheel and loaded within a primary cage which effectively compresses the spring element while the spring element resides therein due to a restricted internal diameter of the cage. When the loading has been accomplished, a trap door actuates a microswitch which activates a primary air cylinder. The primary air cylinder then imparts an axial force upon the compressed spring element causing it to pass into a secondary cage located within a rotor juxtaposed the primary cage.

The secondary cage has a diameter larger than the primary cage, thus the spring element is caused to expand within that secondary cage. In the preferred embodiment the secondary cage is rotated by a drive mechanism controlled by a timing chain upon which spaced screwheads are positioned. Just prior to the activation of the primary air cylinder, the screwheads upon the timing chain engage a stop mechanism, thus momentarily terminating rotation of the timing chain and the controlled secondary cage. As stated earlier, the activation of the primary air cylinder causes the spring element within the primary cage to pass into the secondary cage. After the spring element has been loaded into the secondary cage from the primary cage, a switch activates a trip solenoid which causes the stop mechanism to disengage the screwhead, thus permitting free rotation of the timing chain and corresponding rotation of the secondary cage. By mounting the screwheads with a predetermining distance between them, the springs are nested in a consecutive manner such that optimum storage efficiency is achieved.

The timing chain also has at least one extended screwhead which actuates a microswitch when it passes thereunder. Actuation of this microswitch causes a single rotation device to rotate the secondary cage away from the primary cage. By placing a preselected number of screwheads upon the timing chain prior to the position of the extended screwhead, it is possible to control the number of spring elements placed within the secondary cage prior to its movement. As the secondary cage is rotated away from the primary cage a microswitch activates a secondary air cylinder which imparts an axial force upon the rotated secondary cage, within which the nested spring elements are located, thus forcing the nested configuration into a chute for subsequent ejection.

Therefore, it is the object of the present invention to provide an apparatus for nesting elongated articles.

It is another object of the present invention to provide an apparatus that controls the disposition of nested spring elements with respect to each other within a nested configuration.

It is another object of the present invention to selectively control the number of spring elements found within any nested configuration.

It is still another object of the present invention to provide an apparatus for simultaneously nesting spring elements and ejecting nested configurations from the apparatus.

It is another object of the present invention to nest curvilinear spring elements of various lengths.

These and other objects and advantages of the present invention will become apparent from the detailed description taken in connection with the accompanying drawings.

DESCRIPTION OF THE PREFERRED EMBODIMENT

Figure 1:
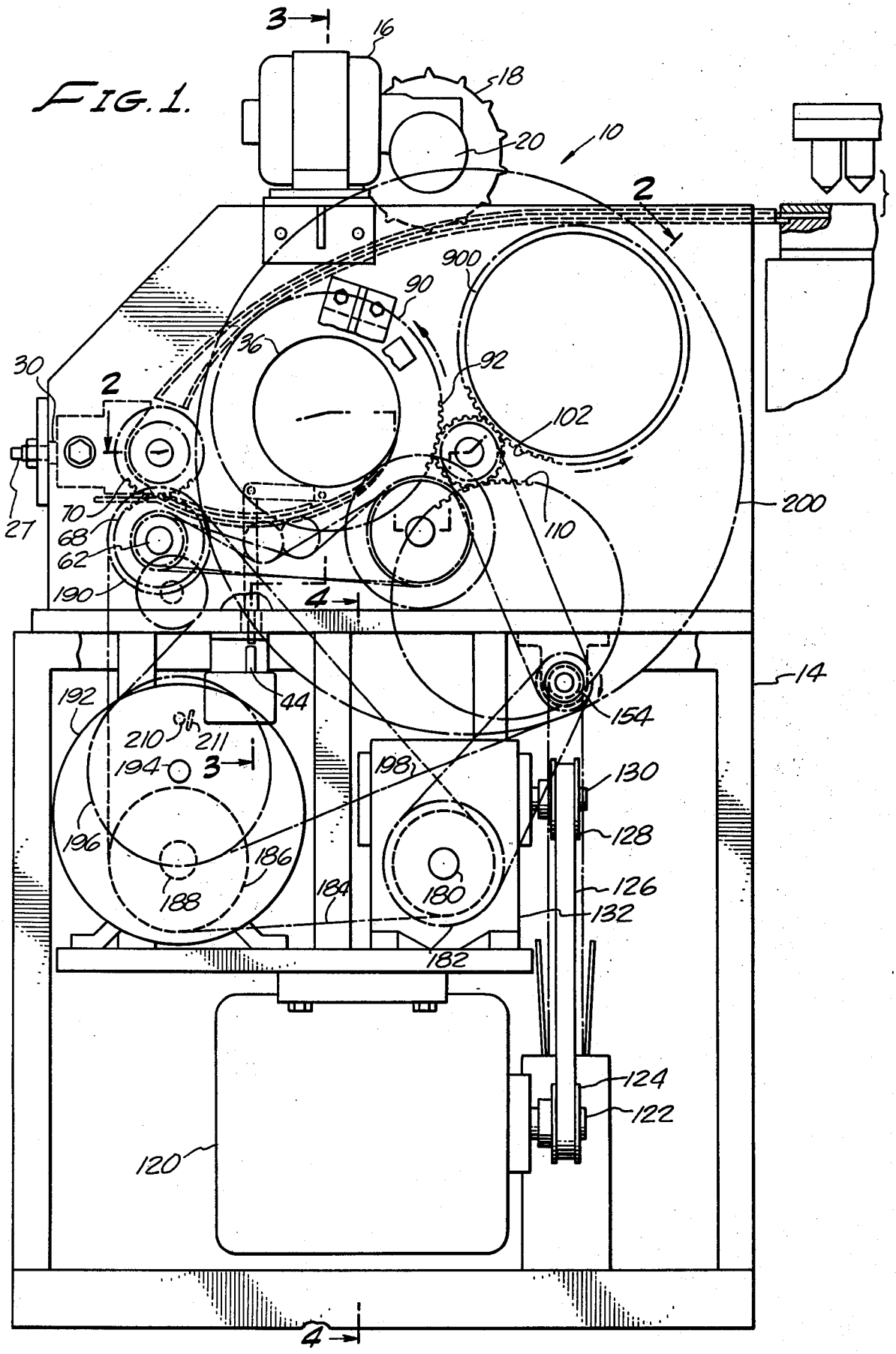
FIG. 1 is a schematic front view of the spring nesting apparatus embodying the present invention.

Referring now in detail to the drawings, a preferred embodiment of the spring nesting apparatus of the present invention, generally designated 10, broadly includes a housing 12 supported by a frame 14. Mounted upon the housing 12 is a motor 16 which drives a feed wheel 18 via a slip clutch 20.

Figure 5:
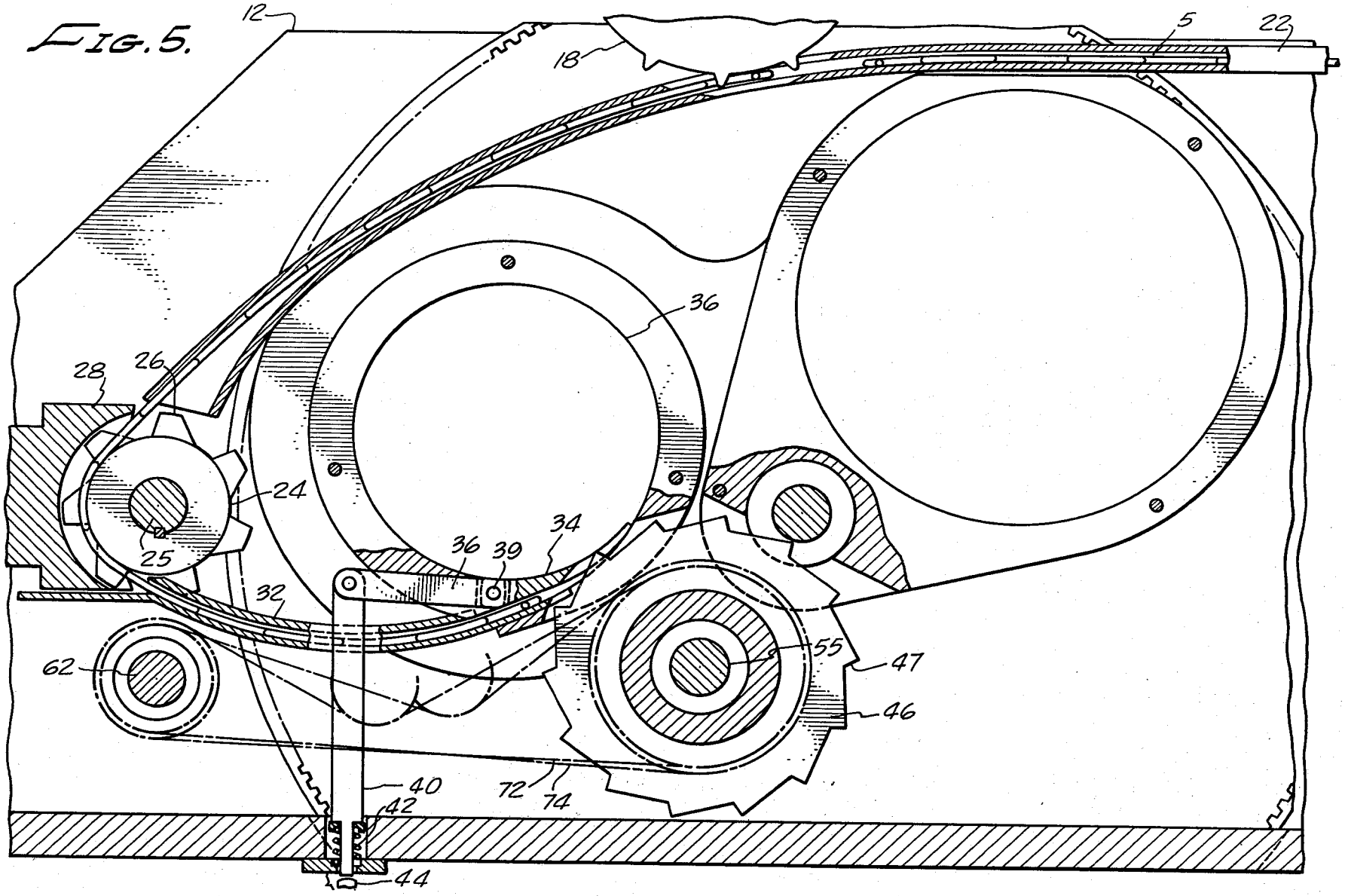
FIG. 5 is a cross-section through the spring nesting apparatus illustrating the parts thereof in a position assumed during the initial nesting process.

Referring to FIGS. 1 and 5, the housing 12 has a chute 22 into which the feed wheel 18 extends, said wheel 18 having teeth 19 which engage the lateral bars at the spring element thus providing the force by which a precut spring element is driven into the nesting apparatus 10. As the precut spring element leaves the chute 22, it is caused to pass over an arching roll 24 keyed to a shaft 25, said arching roll 24 having teeth 26 which engage the lateral bars of the sinuous spring element. A roll shoe 28 oppositely positioned from the arching roll 24 works in conjunction therewith imparting the desired curvilinear shape to the precut spring element. The roll shoe 28 is attached to a keyed slide 30 which is slidably adjustable upon the shaft 27. Disposed below the arching roll 24, a curved second chute 32 is adapted to guide the spring element after it leaves the arching roll 24 into a nesting position, said chute 32 being curved so that minimum spring expansion is achieved. At the terminal end of the second chute 32, a trap 34 coplanar with the top of the chute 32 permits entry of the spring element into a primary cage 36. The trap 34 is integral with an arm 38 which is linked to a push rod 40, said arm 38 being pivoted about a pin 39. At the lowermost portion of the push rod 40, a spring 42 provides constant upward force thus causing the trap 34 to be concentric with the interior diameter of the primary cage 36 when in an inoperative position.

Referring in particular to FIG. 5, when the sinuous spring element passes under the trap 34, the push rod 40 is caused to move in a downward direction engaging the plunger of a microswitch 44, actuating said switch 44. The spring element is pulled through the second chute 32 by a feed wheel 46 partially disposed within the medial portion of the trap 34. Teeth 47 on the wheel 46 engage lateral bars of the spring element thereby forcing the spring element into the primary cage 36.

Figure 2:
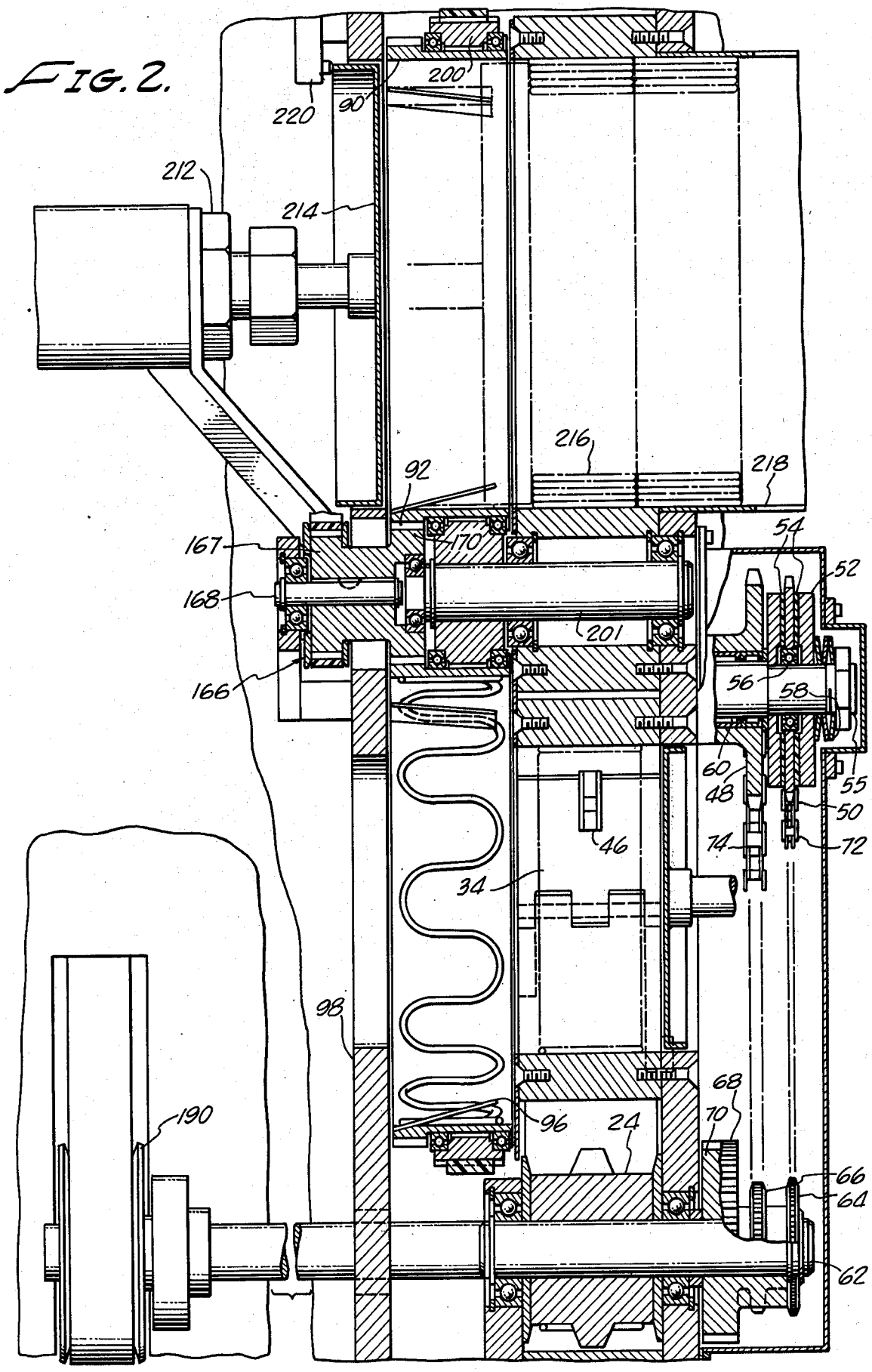
FIG. 2 is a cross-sectional view taken substantially on the line 2—2 upon FIG. 1 in the direction indicated.
Figure 3:
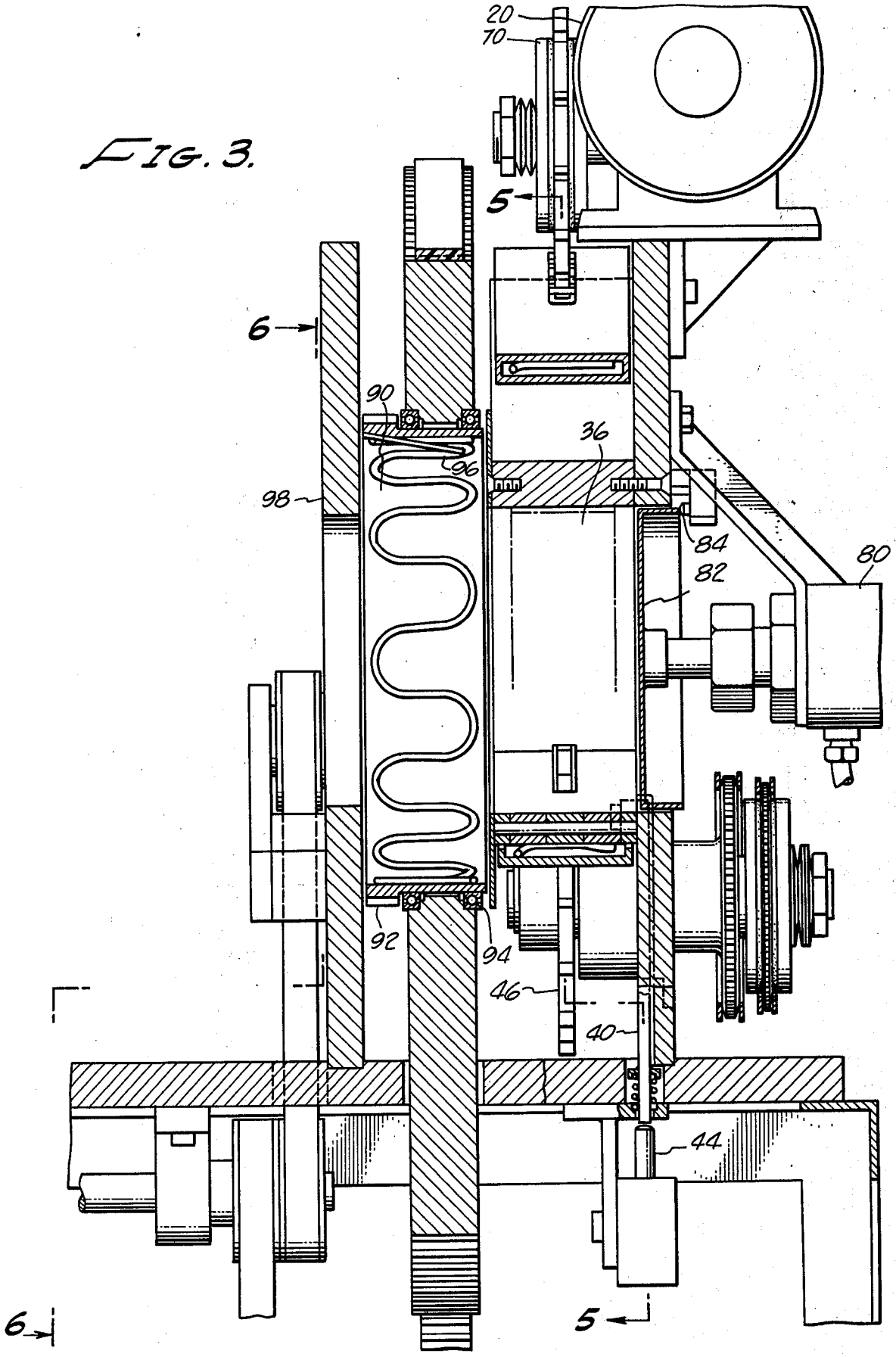
FIG. 3 is a cross-sectional view taken substantially on the line 3—3 upon FIG. 1 in the direction indicated.

As shown in FIGS. 2 and 3, the feed wheel 46 is coaxial with a first sprocket 48 and a second sprocket 50. The sprocket 50 is encased by disks 52, mounted on a shaft 55 with friction elements 54 disposed therebetween. Bearings 56 permit independent rotation of the second sprocket 50 from the shaft 55, while a Belleville spring 58 urges the disks 52 and the second sprocket 50 into an engaged rotation. An override clutch 60 is provided between the first sprocket 48 and the shaft 55.

Keyed to a shaft 62 are a first sprocket 64, a second sprocket 66 and a gear 68. The gear 68 intermeshes with an oppositely positioned gear 70 which is coaxial with the arching roll 24, said gear 70 being keyed to the shaft 25. Thus, movement of the shaft 62 causes engaged rotation of the arching roll 24. The sprocket 64 is in substantial alignment with the sprocket 50, and the sprocket 66 is in substantial alignment with the sprocket 48. As shown in FIG. 2, a roller chain 72 engages the sprocket 50 with the sprocket 64, and a second roller chain 74 engages the sprocket 48 with the sprocket 66.

Due to the difference in diameters between the sprocket 64 and sprocket 66, the sprocket 50 is caused to rotate faster than the sprocket 48. Because the feed wheel 46 is mounted upon the same shaft 55 as the sprocket 50, the wheel 46 when not engaging spring elements moves at a speed faster than the sprocket 48. This is facilitated by the override clutch 60 which permits the sprocket 48 to rotate freely at that time. As the spring elements approach the feed wheel 46 there is no accurate method of determining the position of the lateral bars of the spring element. Since the feed wheel 46 is then being driven by the sprocket 50, it will gain upon the spring elements until such time as the teeth 47 engage lateral bars of the spring element. This engagement imparts a negative torque upon the feed wheel 46. At this point the override clutch 60 engages the hard drive sprocket 48 with the shaft 55, and the spring element is driven into the primary cage 36 by the feed wheel 46.

After the hard drive sprocket 48 has caused the feed wheel 46 to drive the spring elements into the primary cage 36, the spring 42 acts upon the push rod 40 disengaging the rod 40 from the plunger of the microswitch 44. The microswitch 44 then causes a pulse generator to fire a reciprocating primary air cylinder 80 as shown in FIG. 3. The primary air cylinder 80 has a piston face 82, the diameter of said piston face 82 being approximately the smaller as the internal diameter of the primary cage 36. The air cylinder 80 forces the piston face 82 through the primary cage 36 causing the spring element to pass into a secondary cage 90. When the piston face 82 returns from the primary cage 36, it engages the plunger of a dual microswitch 84. As stated earlier, the secondary cage 90 has a diameter greater than the internal diameter of the primary cage 36, thus the compressed spring elements are expanded within the secondary cage 90. Gear teeth 92 circumferentially extend from the secondary cage 90 and are adapted to permit engaged rotation of the secondary cage 90 with bearings 94 facilitating this rotation. As best shown in FIG. 2, within the secondary cage 90 a leaf spring 96 acts to restrict the rotational movement of the nested spring elements thus affixing the elements within the secondary cage 90. A back wall 98 acts to prevent the spring elements from leaving the secondary cage 90 despite the subsequent nesting of additional spring elements therein.

As illustrated in FIG. 1, in the preferred embodiment, the spring nesting machine 10 has two additional secondary cages, 100, 110. The secondary cage 100 also has gear teeth 102 circumferentially positioned to provide engaged rotation of the secondary cylinder 100. A similar arrangement is found on a secondary cage 110 which is also adapted to rotate.

Figure 4:
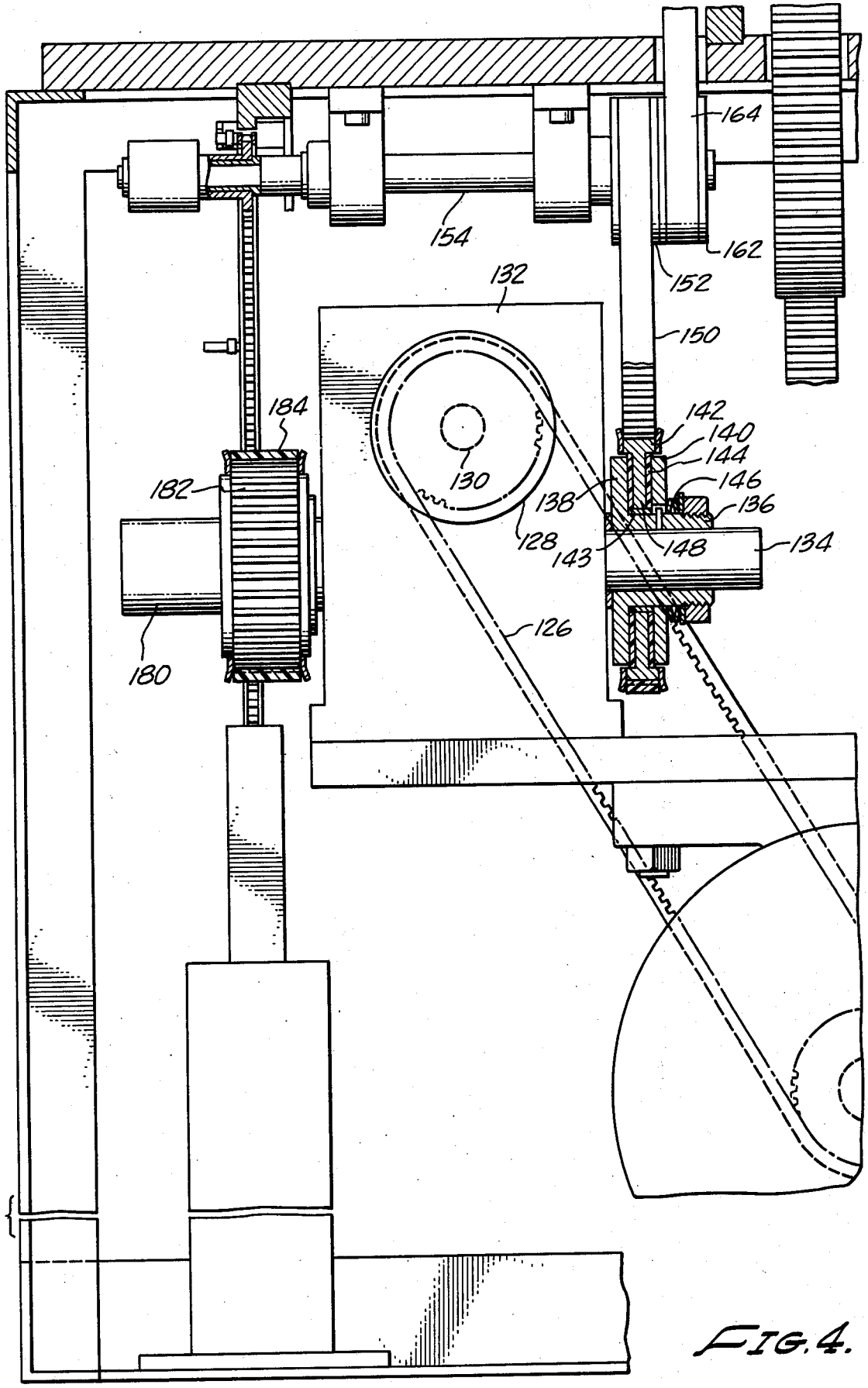
FIG. 4 is a rear partial view of the control elements of the present invention.

In FIGS. 1 and 4, a motor 120 has a drive shaft 122 upon which a pulley 124 is mounted. A belt 126 is driven by the pulley 124 and causes rotation in a pulley 128. The pulley 128 causes rotation in a shaft 130 which passes into a worm gear transmission 132. As illustrated in FIG. 4, the worm gear transmission 132 has a drive shaft 134 extending therethrough. The drive shaft 134 has a hub 136 circumferentially mounted thereon, the hub 136 having a first perpendicular member 138 and a second perpendicular member 140 securing a slip element 142 rotably mounted there-between. Friction elements 144 disposed between member 138 and slip element 142 and member 140 and slip element 142 permit engaged rotation, as a Belleville spring 146 urges the members 140 and 138 into a clamping arrangement with the slip element 142. Bearing 143 permit independent rotation of the slip element 142 from the sleeve 136 and the shaft 134 when a counter rotational torque acts upon the slip element 142. A timing belt 150 engages a pulley 152 with the slip element 142, whereby rotation in the slip element 142 causes rotation of the pulley 152 and the shaft 154 onto which the pulley 152 is keyed.

Figure 6:
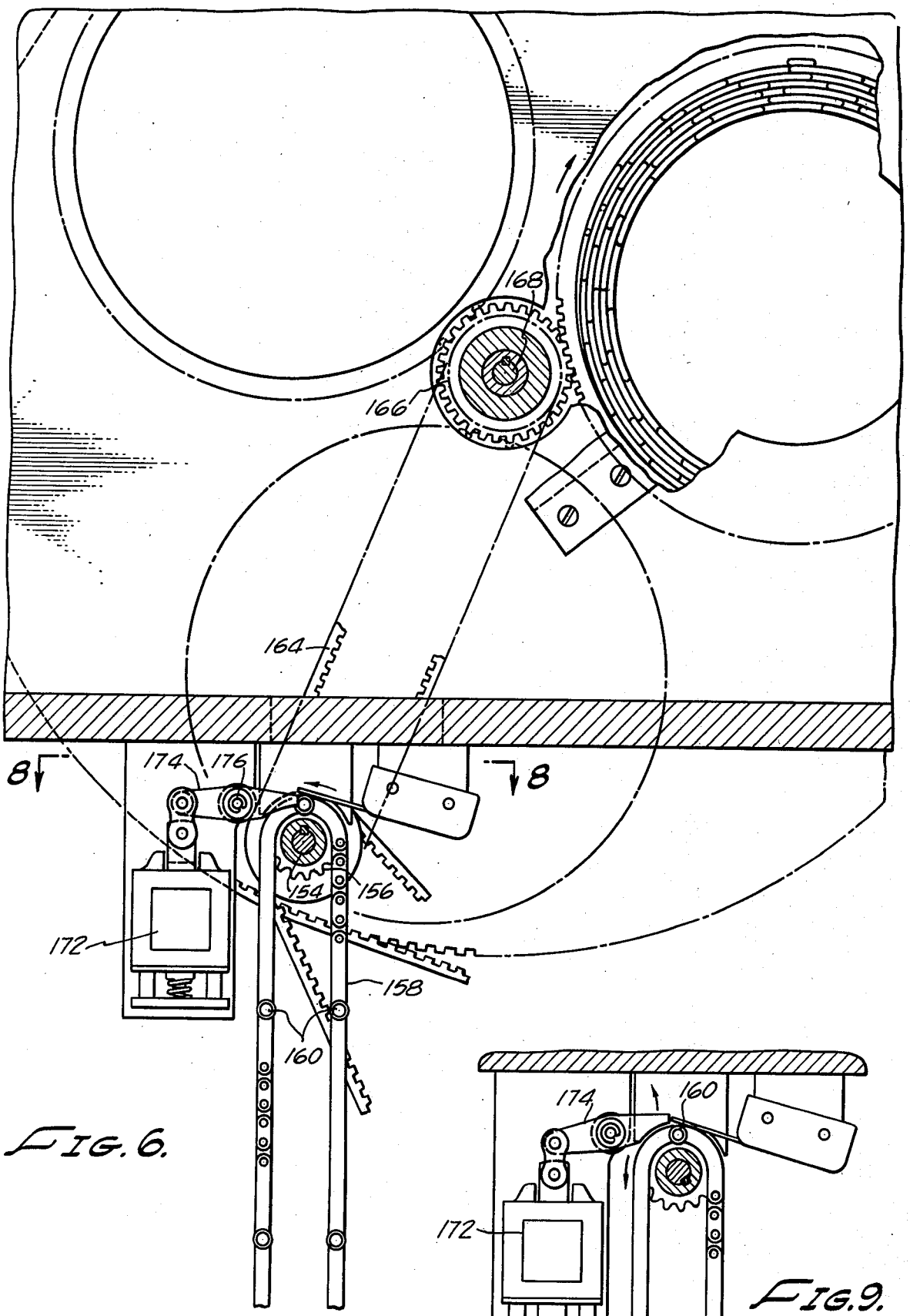
FIG. 6 is a rear view of the timing elements of the present invention.
Figure 8:
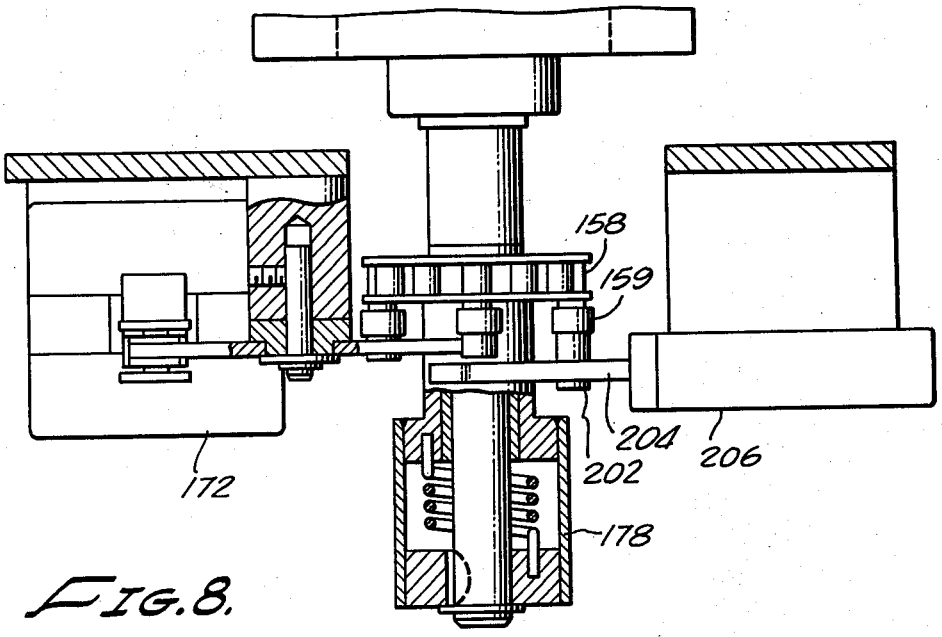
FIG. 8 is a top view of the timing elements of the present invention.

Turning to FIGS. 6 and 8, front and top views of the nesting apparatus control elements are shown. In FIG. 6, the shaft 154 has keyed thereon a sprocket 156 around which a timing chain 158 is trained, thus rotation in the shaft 154 causes a movement in the timing chain 158. Nuts 159 which are welded to the timing chain 158 are adapted to receive screwheads 160, said screwheads 160 being spaced according to the length of the spring elements to be nested, and the desired configuration that they are to take in the nested configuration. The nuts 159 are welded at preselected points upon the chain 158, each nut 159 adapted to receive a screwhead 160, however, in the preferred embodiment, not every nut 159 has a screwhead 160 joined thereto. In FIGS. 4 and 6, a second pulley 162 also mounted upon the shaft 154 drives a timing belt 164 which in turn drives a pulley and gear cluster 166 found upon a freely rotatable idling shaft 168. In FIG. 2, a cross section of a pulley and gear cluster 166 is shown. As the cluster 166 rotates with the shaft 168, teeth 170 intermesh with the gear teeth 92, 102, and 112 upon the respective secondary cages. In this manner, the secondary cages are rotated when the belt 164 is rotating the pulley portion 167.

In FIG. 6, a trip solenoid 172 is linked to a stop lever 174 which is pivotal about a shaft 176. The stop lever 174 engages the screwheads 160 found upon the timing chain 158 as they pass therewith, while a shock absorber 178 dissipates the impact resultant from this engagement. This causes momentary stoppage in the timing chain 158 which in turn causes terminated rotation of the sprocket 156 and the shaft 154. As the shaft 154 stops rotating, the belt 164 stops its movement and the cluster 166 terminates rotating. Thus, when the stop member 174 has engaged a screwhead 160, the rotation of the secondary cages 90, 100, and 110 is momentarily arrested. It is to be noted that the slip element 142 stops independent of the shaft 134 at this time.

Figure 9:
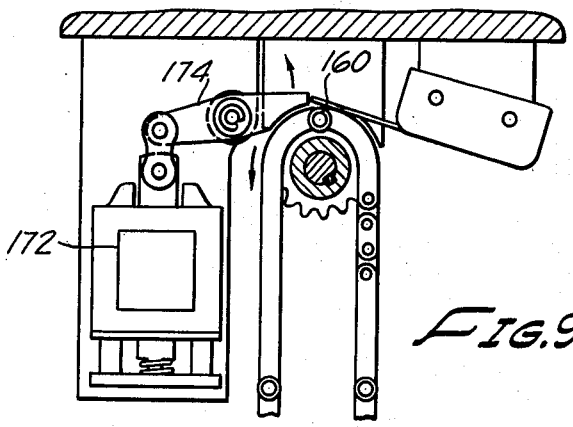
FIG. 9 is a rear view of the trip solenoid in a second position.
Figure 7:
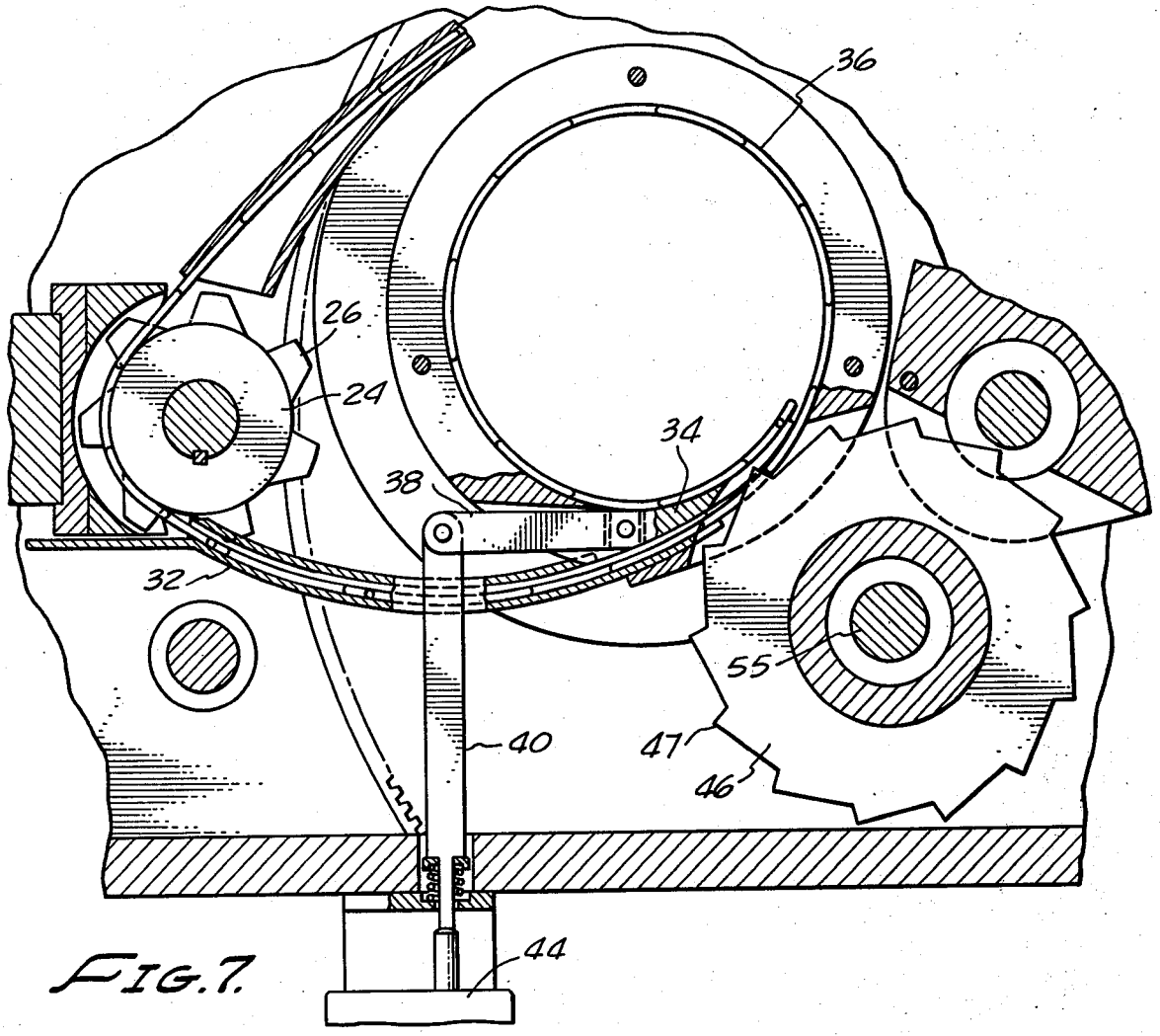
FIG. 7 is a cross-section through the spring nesting apparatus illustrating the parts thereof in a position assumed as a spring element is being nested.

By placing the screwheads 160 upon the chain 158 in a predetermined spacial relationship, the secondary cage 90 is stopped just prior to the implantation of a spring element from the primary cage 36 by the piston face 82. Referring to FIGS. 3 and 9, as the piston face 82 retracts from its extended position, it engages a dual microswitch 84 which in turn causes the trip solenoid 172 to move in a downward position thereby releasing the stop lever 174 from engagement with the screwhead 160. The chain 158 then continues its rotation about the sprocket 156 until such time as another screwhead 160 engages the stop lever 174.

Referring back to FIG. 4, the worm gear transmission 132 has a torque limiter 180 upon the shaft 134, said torque limiter 180 having a pulley 182 integral therewith. The pulley 182 engages a timing belt 184 which engages a pulley 186 keyed to a shaft 188, said shaft 188 entering a single revolution unit 192. The timing belt 184 passes also to a drive pulley 190 mounted upon the shaft 62 before passing again to the pulley 182, thereby providing drive to the arching roll 24 and the sprockets 64, 66.

The shaft 188 passes into a single revolution unit 192 which has a second shaft 194 extending therefrom. The shaft 194 has a pulley 196 keyed thereto about which a belt 198 is trained, said belt 198 further extending about a rotor 200 in which the secondary nesting cages 90, 100, and 110 are found. In this manner, movement of the belt 198 causes rotation of the rotor 200 thus realigning the secondary cages 90, 100, 110 with respect to the cage 36. As shown in FIG. 2, the rotor 200 revolves about a freely rotational shaft 201.

In FIG. 8, a top view of the timing chain 158 is shown with an extended screwhead 202 joined to the nut 159. The extended screwhead 202 also engages the lever 174 thus performing the same function as a screwhead 160. In addition, as shown in FIG. 8, the extended screwhead 202 passes under an arm 204 outspread from a microswitch 206. As the screwhead 202 leaves the arm 204, the switch 206 fires a pulse generator thereby actuating in the single revolution unit 192. Referring to FIG. 1, the single revolution unit 192 when activated causes the pulley 196 to rotate thereby causing rotation in the rotor 200. One full rotation of the pulley 196 causes another secondary cage within the rotor 200 to move in coaxial alignment with the primary cage 36. A microswitch 211 is fired by an extending member 210 mounted upon the pulley 196. Activation of the microswitch 210 causes a reciprocating secondary air cylinder 212 illustrated in FIG. 2, to pass a piston 214 through the rotated secondary cage 90. In this manner a nested configuration 216 is ejected into an unloading chute 218. When this has been accomplished, the piston 214 retracts and engages the plunger at a switch 220. It is to be noted that the switch 220 and second part of the dual microswitch 84 must be closed for the rotor 200 to be activated thus assuring that the piston 82 and piston 214 are not extended during rotation of the rotor 200.

Figure 10:
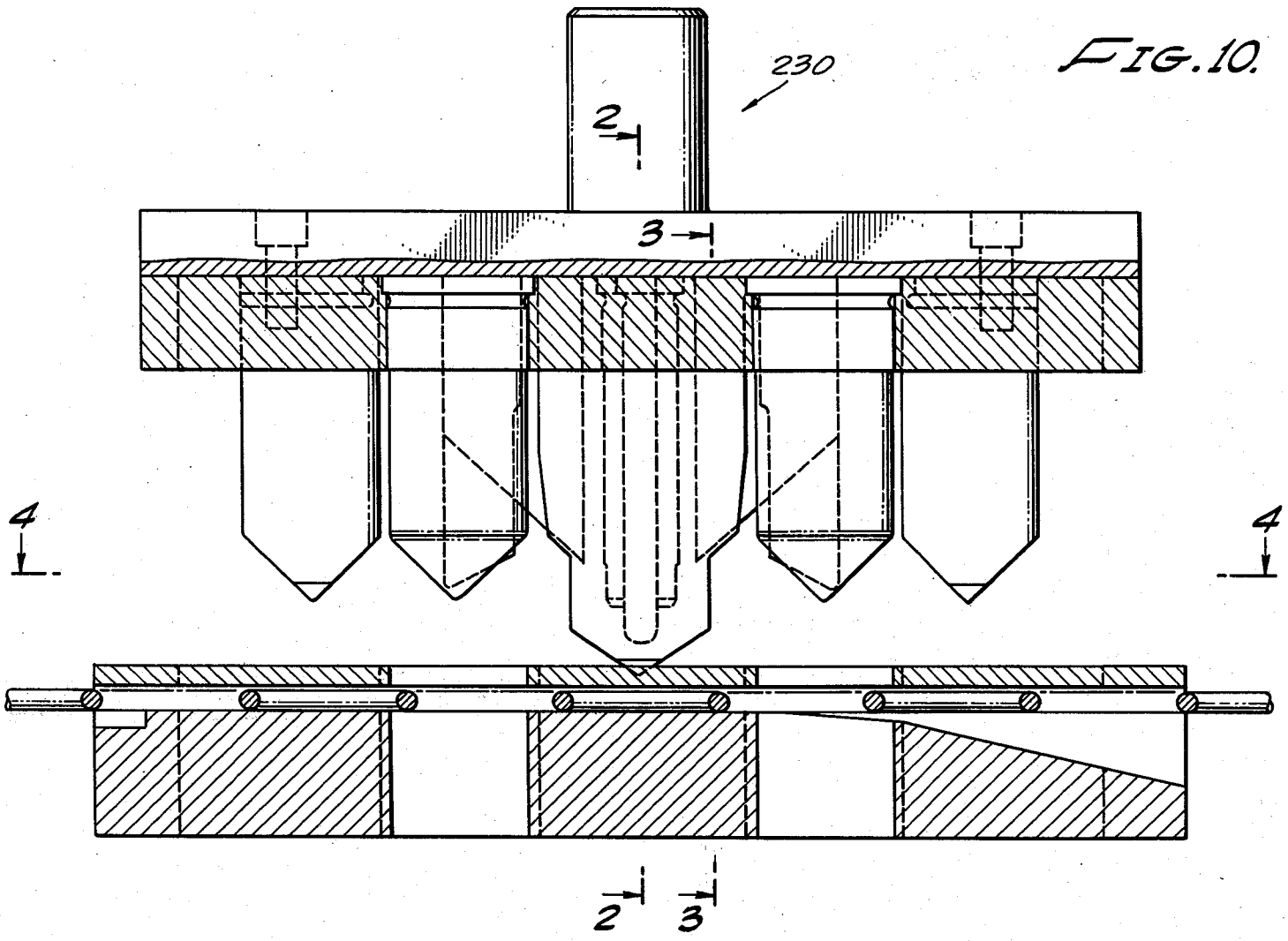
FIG. 10 is a front cross-sectional view of the die used for cutting sinuous spring elements.
Figure 11:
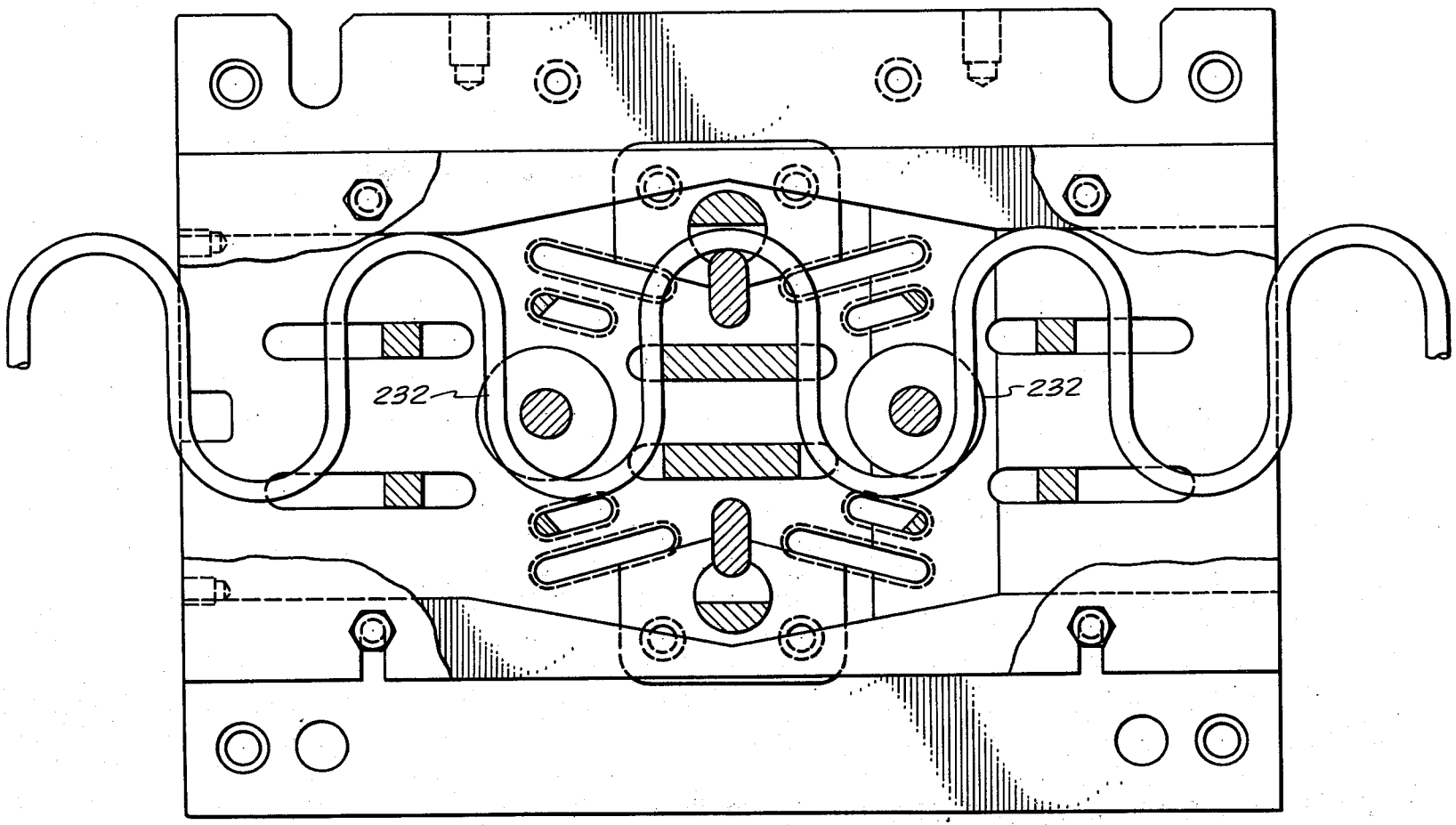
FIG. 11 shows the sinuous spring element positioned within the die previous to cutting.
Figure 12:
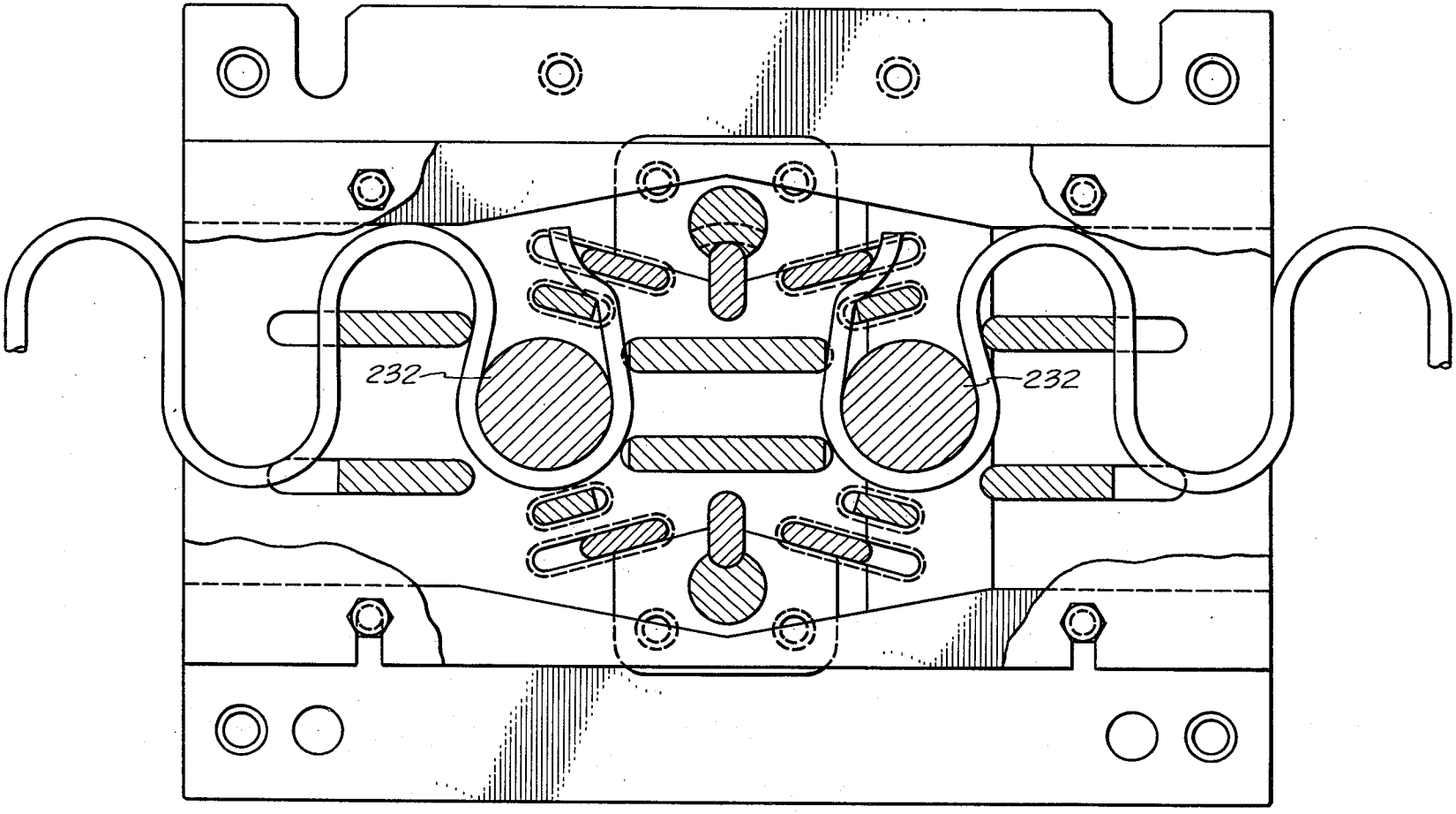
FIG. 12 shows the sinuous spring elements positioned within the die after the cutting has been accomplished.

In FIG. 10, a die 230 is disclosed to operate in conjunction with the spring nesting machine 10. As shown in FIGS. 11 and 12, the die 230 has locating pins 232 which grab convolutions within the spring element after its severance but prior to the end bending procedure. In this manner reduced distortion in the spring element is achieved. This is particularly significant in the nesting process as this reduced distortation lessens the possibility of interlocking ends during the nesting process.

Figure 13:
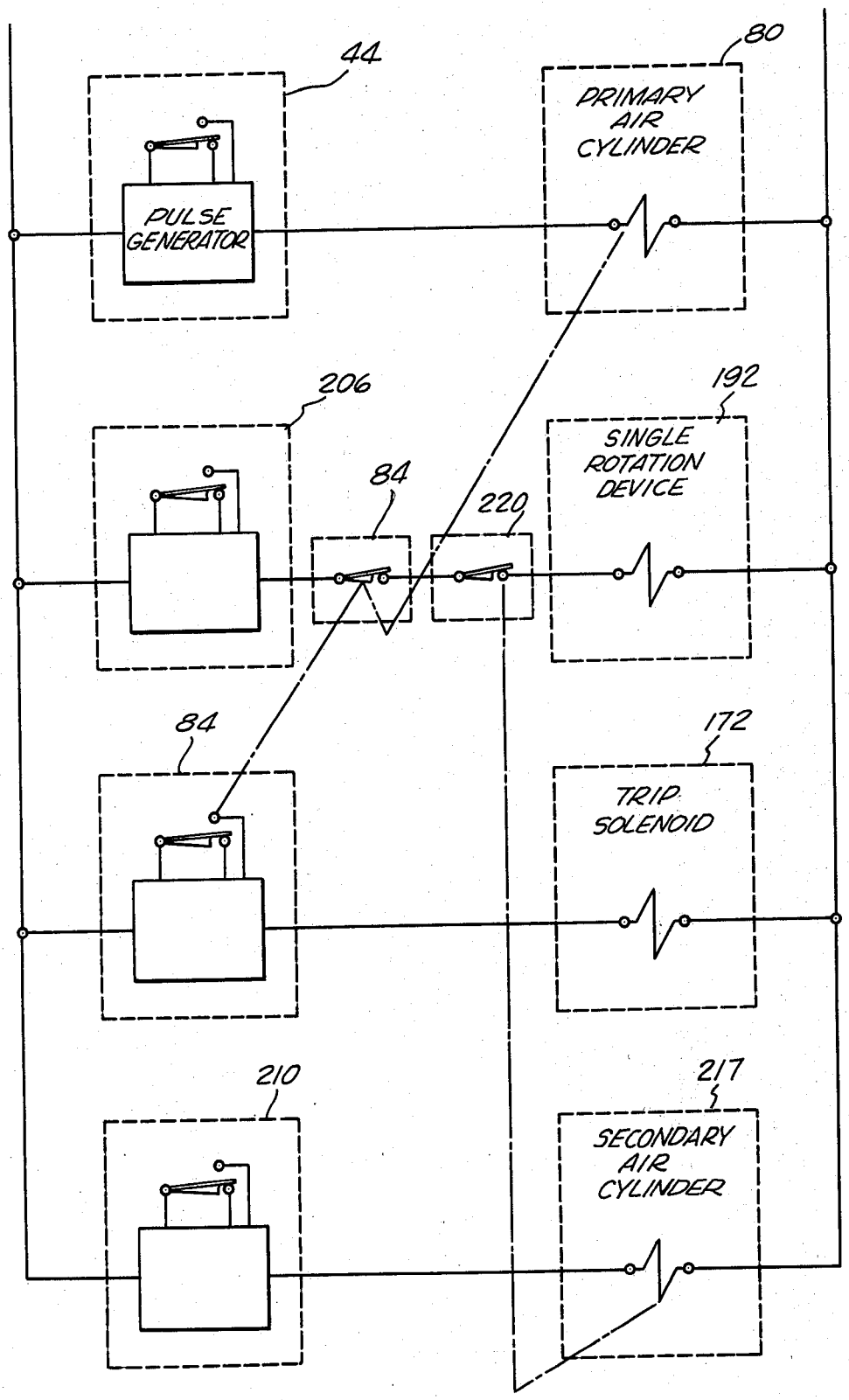
FIG. 13 is a schematic wiring diagram of the present apparatus.

In FIG. 13, a schematic of the operation of the spring nesting machine 10 is illustrated. There are basically five switches involved, respectively, 44, 84, 206, 210 and 220, switch 84 being a dual microswitch incorporated within the electrical schematic of FIG. 13. In operation the motor 120 causes power to be transferred to the worm gear transmission 132 which in turn drives the shaft 154 and shaft 62. As the spring element passes down the chute 22, it engages the arching roll 24. The spring is bent and caused to pass into the second chute 32 where it engages the teeth 47 of the feed wheel 46. Because of the slip arrangement provided by the dual sprockets 48, 50, the spring is forced under the trap 34 and into the primary cage 36. At the same time the worm gear transmission 132 drives the shaft 154 which in turn causes the timing chain 158 to rotate about its sprocket 156. As the screwheads 160 engage the stop lever 174, the shaft 154 terminates its rotation and the cluster 166 similarly terminates its rotation. This causes the secondary cages 90, 100, and 110 to momentarily stop rotating. As stated earlier, after the spring element is loaded into the primary cage 36, the trap 34 moves downward into an concentric position with the internal surface of the primary cage 36 causing the switch 44, shown in FIG. 13 to activate the reciprocating primary air cylinder 80. This causes the piston face 82 to pass through the primary cage 36 thus forcing the spring element into the momentarily stationary secondary cage 90. As the piston face 82 retracts from the primary cage 36, it engages the dual switch 84. Referring to FIGS. 9 and 13, the switch 84 when closed activates the trip solenoid 172 causing the stop lever 174 to disengage the screwhead 160. In this manner the cluster 166 is again permitted to rotate thus rotating the secondary cages 90, 100, and 110. By this procedure a desired rotational alignment of the spring elements within the nested configuration 216 is achieved.

As the timing chain 158 passes in an engaged rotation with the sprocket 156, an extended screwhead 202 will pass under the arm 204, the screwhead 202 activating the switch 206 as it leaves said arm 204. As shown in FIGS. 1 and 13, when the switch 206 is closed and the switch 84 is closed and the switch 220 is closed, the single rotation device 192 causes the rotor 200 to realign a different secondary cage with respect to the primary cage 36. After the single revolution unit 192 has rotated the rotor 200, a switch 211 is closed by an arm 210 located upon the pulley 196, the switch 201 then activating the secondary air cylinder 212. The secondary air cylinder 212 causes a piston 214 to pass through the rotated secondary cage 90, 100, and 110 thus forcing the nested configuration 216 into the chute 218. When the piston 214 retracts, it reengages the plunger of the microswitch thus assuring that the rotor 200 is not moved while the piston 214 is in an extended position.

By placing a preselected number of screwheads 160 before an extended screwhead 202 on the timing chain 158, it is possible to control the number of spring elements within a nested configuration 216. Similarly, by placing the screwheads 160 at preselected intervals it is possible to nest various length springs in a nested configuration 216. Also by varying the relative distance between the screwheads 160 a multitude of rotational dispositions of the springs within the nested configuration 216 is possible.

Thus, it is readily apparent from the foregoing description that the present invention provides a highly reliable yet high speed apparatus for nesting spring elements.

Having fully described my invention, it is to be understood that I do not wish to be limited to the details set forth, but my invention is of full scope of the appended claims.

I claim:

1. An elongated element nesting apparatus, said apparatus comprising;

a housing, a primary cage within said housing, a secondary cage coaxial with said primary cage and laterally displaced therefrom, a means for longitudinally loading an elongated element into said primary cage, a means for laterally forcing said elongated element from said primary cage into said coaxial secondary cage, a means for controlling the number of elongated elements forced into said secondary cage, a plurality of secondary cages having their axes parallel and laterally displaced from said secondary cage, a means for rotating said plurality of secondary cages into consecutive coaxial relationship with said primary cage, and a means for forcing said elongated elements from said secondary cage.

2. A machine for nesting curvilinear articles which comprises:

a stationary primary cage, a rotary secondary cage coaxial with said primary cage and laterally displaced therefrom, a means for guiding a spring element into said primary cage, a timing chain, said timing chain adapted to control rotation of said rotary secondary cage, a piston, said piston adapted to force an element from said primary cage into said coaxial secondary cage, a means for controlling the number of elements forced into said coaxial secondary cage, a means for longitudinally rotating said laterally displaced and coaxial secondary cage away from said primary cage, a second piston, said piston adapted to facilitate the unloading of said secondary cage.

3. The apparatus of claim 2, which includes a sensing means, said sensing means having first and second arches, whereby said first arch is concentric with the internal diameter of said primary cage and said second arch is coplanar with said guide means.

4. In a spring nesting machine the apparatus comprising:

a housing, a rotor juxtaposed said housing, a means for rotating said rotor, an arching roll, said roll adapted to impart a curvilinear shape to spring elements, a primary cage within said housing, a means for guiding said spring elements into said primary cage, a piston adapted to force an element from said primary cage, a sensing mechanism, said mechanism adapted to control axial movement of said piston through said primary cage, a multiplicity of spaced secondary cages within said rotor adapted to receive spring elements from said primary cage when in coaxial relationship therewith.

a means for rotating said multiplicity of secondary cages within said rotor, a timing chain, said timing chain having means for controlling the number of spring elements placed within said secondary cage, said timing element also having a means for controlling the rotation of said secondary cages within said rotor, a second piston, said piston adapted for forcing said spring elements from said secondary cage.

5. The apparatus of claim 4, wherein said arching roll is displaced from said primary cage a discreet distance whereby spring element expansion is minimized.

6. An elongated element nesting apparatus, said apparatus comprising:

a housing, a primary cage within said housing, a secondary cage coaxial with said primary cage and laterally displaced therefrom, said second cage being larger in cross-sectional dimension than said primary cage, a means for longitudinally loading an elongated element into said primary cage, a means for laterally forcing said elongated element from said primary cage into said coaxial secondary cage, and a means for laterally forcing a plurality of elongated elements from said secondary cage.

7. The apparatus of claim 6 wherein said means for longitudinally loading an elongated element into said primary cage includes an opening in the periphery of said primary cage and a wheel mounted about an axis parallel to the axis of said primary cage, said wheel being adjacent said opening to engage the elongated element.

8. The apparatus of claim 6 wherein said means for laterally forcing said elongated element from said primary cage into said coaxial secondary cage includes a pusher aligned with said primary cage for axial movement therethrough and a means for driving said pusher through said primary cage.

9. The apparatus of claim 6 wherein said means for laterally forcing elongated elements from said secondary cage is displaced laterally from said means for laterally forcing said elongated element from said primary cage into said coaxial secondary cage, said apparatus further comprising a structural support for said coaxial secondary cage mounted to said housing at a distance from said secondary cage and drive means for moving said secondary cage from coaxial alignment with said primary cage into coaxial alignment with said means for laterally forcing elongated elements from said secondary cage.

10. The apparatus of claim 9 further including a plurality of secondary cages mounted to said support structure and constructed and arranged for selective coaxial alignment with said primary cage.

11. An elongated element nesting apparatus, said apparatus comprising:

a housing, a primary cage within said housing, a secondary cage capable of being coaxially aligned with said primary cage and laterally displaced therefrom, said secondary cage being rotatably mounted relative to said housing about the axis of said secondary cage and being of larger cross-sectional dimension than said primary cage, a means for longitudinally loading an elongated element into said primary cage, a means for laterally forcing said elongated element from said primary cage into said coaxial secondary cage, and an indexing means for rotating said secondary cage such that succeeding elongated elements forced from said primary cage have a leading end adjacent the trailing end of the previous elongated element in said secondary cage.

12. The apparatus of claim 11 further including a pusher constructed and arranged to force elongated elements from said secondary cage.

* * * * *